United States Patent [19]

Ikada et al.

[11] Patent Number: 5,010,145

[45] Date of Patent: Apr. 23, 1991

[54] POLYLACTIC ACID FIBER

[75] Inventors: Yoshito Ikada; Shokyu Gen, both of Uji, Japan

[73] Assignee: Daicel Chemical Industries, Ltd., Sakai, Japan

[21] Appl. No.: 182,184

[22] Filed: Apr. 15, 1988

[30] Foreign Application Priority Data

Apr. 21, 1987 [JP] Japan ..... 62-98337

[51] Int. Cl.[5] ..... C08G 63/08; C08L 67/04

[52] U.S. Cl. ..... 525/415; 528/254; 606/230

[58] Field of Search ..... 525/415; 528/354

[56] References Cited

U.S. PATENT DOCUMENTS

| | | | |
|---|---|---|---|
| 2,758,987 | 8/1956 | Salzberg | 528/354 |
| 3,531,561 | 9/1970 | Trehu | 528/354 X |
| 4,157,437 | 6/1979 | Okuzumi et al. | 525/415 X |
| 4,279,249 | 7/1981 | Vert et al. | 525/415 X |
| 4,300,565 | 11/1981 | Rosensaft et al. | 528/354 X |
| 4,719,246 | 1/1988 | Murdoch et al. | 525/415 X |
| 4,766,182 | 8/1988 | Murdoch et al. | 525/415 X |

FOREIGN PATENT DOCUMENTS 61-36321 2/1986 Japan .

*Primary Examiner*—Earl Nielsen

*Attorney, Agent, or Firm*—Flynn, Thiel, Boutell & Tanis

[57] ABSTRACT

A polylactic acid fiber comprises a blend of poly-L-lactic acid and poly-D-lactic acid and is improved by spinning and then drawing.

11 Claims, No Drawings

POLYLACTIC ACID FIBER

The present invention relates to a polylactic acid fiber having a high strength and a high thermal resistance, and more specifically to a novel polylactic acid complex fiber having physical properties incomparably superior to those of a conventional polylactic acid fiber.

DESCRIPTION OF THE PRIOR ART

Polyglycolic acid and polylactic acid, which are aliphatic polyesters, are interesting in vivo degradable and absorbable polymers which undergo non-enzymatic hydrolysis in vivo to form glycolic acid and lactic acid, respectively, as degradation products which undergo metabolism in vivo.

Polyglycolic acid is widely used clinically as an absorbable suture. Since it shows a high degradation and absorption rate in vivo, however, it cannot be used in a part where it is required to maintain its strength for more than several months. Meanwhile the formation of a fiber from polylactic acid and application thereof as an absorbable suture are also under investigations [see B. Eling, S. Gogolewski, and A. J. Pennings, Polymer, 23, 1587 (1982); Y. M. Trehu, Ethicon, Inc., U.S. Pat. No. 3,531,561 (1970); and A. K. Schneider, Ethicon, Inc., U.S. Pat. No. 3,636,956 (1972)]. However, a polylactic acid fiber is unsatisfactory with respect to mechanical properties and thermal properties [see S. H. Hyon, K. Jamshidi, and Y. Ikada, "Polymers as Biomaterials", edited by Shalaby W. Shalaby, Allan S. Hoffman, Buddy D. Ratner, and Thomas A. Horbett, Plenum, N.Y., (1985)].

A blend of poly-L-lactic acid and poly-D-lactic acid is disclosed in Japanese patent publication A No. 61-36321.

SUMMARY OF THE INVENTION

An object of the present invention is to provide a polylactic acid fiber having a high strength and a high melting point which are significantly higher than the mechanical properties (tensile strength: 70 kg/mm$^2$ or lower) and thermal properties (melting point: 180° C. or lower) of the conventional polylactic acid.

Under these circumstances the inventors of the present invention have made intensive investigations with a view to improving the physical properties of a polylactic acid fiber. As a result, they have completed the present invention.

The above-mentioned object of the present invention can be attained by using a blend of poly-L-lactic acid and poly-D-lactic acid each of which is polylactic acid in its entity and different from each other only in optical activity.

Specifically, the present invention relates to a polylactic acid fiber characterized by consisting of a blend of poly-L-lactic acid and poly-D-lactic acid.

In the invention, a polylactic acid fiber comprises a blend of poly-L-lactic acid and poly-D-lactic acid.

It is preferable that the fiber comprises 99 to 1 percent by weight of the poly-L-lactic acid and 1 to 99 percent by weight of the poly-D-lactic acid. The fiber of the invention is preferred to have a tensile strength of 70 kg/mm2 or larger.

The invention provides a fibrous article for the medical use which is composed of the polylactic acid fiber as defined above.

Moreover the invention provides a process for preparing a polylactic acid fiber, which comprises the step of spinning a blend of poly-L-lactic acid and poly-D-lactic acid by the dry or wet method. The process may be conducted from a solution of the blend in a solvent. The spun fiber may be drawn for improvement of its physical properties such as tensile strength.

The weight-average molecular weights of poly-L-lactic acid and poly-D-lactic acid are determined by measurement of solution viscosities thereof. Those having a weight-average molecular weight of 20,000 to 1,000,000 are suitable. Where high mechanical properties are required, a polymer having a high weight-average molecular weight of 100,000 to 1,000,000 is preferably used. Where high degradation and absorption rates are required while giving priority to the degradation and absorption rates rather than the mechanical properties, poly-L-lactic acid or poly-D-lactic acid having a comparatively low weight-average molecular weight of 20,000 to 100,000 is preferably used and the use of poly-L-lactic acid and poly-D-lactic acid both having a weight-average molecular weight of 20,000 to 100,000 is more preferred. With respect to the optical purities of poly-L-lactic acid and poly-D-lactic acid, the higher, the better. However, an optical purity of 90% or higher will suffice.

A commercially available 90% aqueous solution of poly-L-lactic acid was used as a starting material to be used in the present invention, while poly-D-lactic acid prepared by a fermentation method was used as another starting material. However, they are not limitative in working of the present invention. L-Lactide and D-lactide, which are monomers for obtaining polylactic acid, were synthesized in accordance with the method of Lowe (C. E. Lowe, U.S. Pat. No. 2,668,162). The specific rotatory power [$\alpha$] (in dioxane at 25° C. and 578 nm) of the obtained L-lactide was −260° while that of the obtained D-lactide was +260°. Polymerization of the lactide was carried out by the bulk ring-opening polymerization method. A series of commercially available ring-opening polymerization catalysts can be used in the polymerization. The inventors of the present invention used tin octanoate (0.03 wt. % based on the lactide) and lauryl alcohol (0.01 wt. % based on the lactide) as an example of the catalyst. The polymerization was conducted in a temperature range of 130° to 220° C. The specific rotatory powers of the obtained poly-L-lactic acid and poly-D-lactic acid were −147° and +147°, respectively, irrespective of the molecular weight.

A specific example of production of a polylactic acid fiber according to the present invention will now be described.

Poly-L-lactic acid and poly-D-lactic acid each having a weight-average molecular weight of 20,000 or higher is dissolved in a solvent. Poly-L-lactic acid and poly-D-lactic acid may be separately dissolved or simultaneously dissolved in the same vessel. However, it is preferred to respectively dissolve them in separate vessels and mix them just before spinning. This is because isomeric polymers having a comparatively low molecular weight of 20,000 to 100,000 are liable to form a complex with each other in a state of a solution so that the viscosity of a solution containing both of them increases in a short time after dissolution of them, resulting in gelation. The concentration of a solution may be adjusted according to the molecular weight of a polymer, the desired fineness of a fiber, and the like. It is preferably 1 to 50 wt. %, more preferably 5 to 20 wt. %. In the case of melt spinning, although a blend of poly-L-lactic acid and poly-D-lactic acid in a state of solution may be used, a blend of them in a molten state is preferably used. Specifically, it is preferred to mix them in a solid state and introduce the mixture into a melt spinning machine to effect blending. Although the blending ratio of poly-L-lactic acid to poly-D-lactic acid can be arbitrarily chosen according to the purpose, it is 99 wt %: 1 wt. % to 1 wt. %: 99 wt. %, preferably 30 wt. %: 70 wt. % to 70 wt. %: 30 wt. %. A blending ratio of 1:1 is most preferred for forming a good polylactic acid complex fiber.

In blending poly-L-lactic acid and poly-D-lactic acid, it is preferred to use polymers having the same molecular weights. However, a complex is formed even if polymers having different molecular weights are blended.

The spinning method for producing a polylactic acid fiber may be a dry process, a wet process, or a combination of a dry process and a wet process. A polylactic acid fiber can also be produced by a melt spinning process. The polylactic acid concentration of a spinning solution is suitably 1 to 50 wt. %. In the case of a dry process, the temperature around a nozzle is preferably set in a range of 20° to 100° C. according to the kind of solvent used, and the temperature in a drying cylinder is desirably set in a range of 40° to 120° C. Examples of organic solvents which can be used in wet, dry, or dry and wet spinning of a blend include chloroform, methylene chloride, trichloromethane, dioxane, dimethyl sulfoxide, benzene, toluene, xylene, and acetonitrile. In the case of a wet process, the spinning temperature is preferably 20° to 80° C. and the temperature of a coagulating liquid is preferably 0° to 40° C. As a coagulating liquid for wet spinning or dry and wet spinning, there can be used a single solvent such as methanol, ethanol, acetone, hexane, or water; or a mixture thereof with an organic solvent as used in a spinning solution. The fiber thus obtained is drawn by a dry or wet hot drawing method. The drawing temperature may be 100° to 220° C., preferably 120° to 200° C. In such a method, the fiber may be drawn by single or multiple stage drawing. In the present invention, however, multiple stage drawing is preferred.

In the present invention, there can be obtained a polylactic acid fiber having a high tensile strength of 70 kg/mm$^2$ or higher, preferably 100 kg/mm$^2$ or higher. Thus, the fiber of the present invention is by far superior in mechanical properties to the conventional fiber.

A polylactic acid complex is formed in the polylactic acid fiber of the present invention. Since an undrawn fiber and a fiber having a low draw ratio according to the present invention have a porous structure, application of them as a fiber for separation of a gas or a liquid is conceivable when they are used in the form of hollow fiber. It is also conceivable to use the fiber of the present invention as a medical fiber such as an absorbable suture, an artificial tendon, an artificial ligament, an artificial blood vessel, or a reinforcing material for bone plate or screw, which is used in vivo. Further, application of the fiber of the present invention as an industrial rope or fiber is conceivable.

The polylactic acid complex fiber of the present invention can provide a fibrous material having improved physical properties in all fields of applications where the use of a homopolymer of poly-L-lactic acid or poly-D-lactic acid has heretofore been considered.

EXAMPLES

The following Examples will illustrate the polylactic acid complex fiber of the present invention but should not be considered as limiting the scope of the invention.

EXAMPLES 1 TO 4

Spinning dopes were prepared by combinations of six kinds of poly-L-lactic acids and poly-D-lactic acids having different weight average molecular weights as shown in Table 1 at a blending ratio of 1:1 using chloroform as a solvent.

Wet spinning and dry spinning were conducted by ejecting these dopes from a nozzle having an orifice diameter of 0.5 mm and a number of orifices of 10. Wet spinning was conducted by using a mixture of ethanol and chloroform (100:30 V/V) as a coagulating liquid at 50° C. Dry spinning was conducted by drying spun fibers using a drying cylinder having a length of 50 cm at 50° C. at a spinning rate of 0.2 ml/min at a take-off rate of 1 m/min.

Fibers spun by these methods were drawn in a silicone oil bath having a temperature of 120° to 200° C. at various draw ratios. With respect to the obtained fibers, the tensile strength, elastic modulus, melting point, and heat of fusion were measured under the following measurement conditions. The results in the case of wet spinning are shown in Table 2, while those in the case of dry spinning are shown in Table 3.

Tensile Strength and Elastic Modulus

The measurement was made using Tensilon/UTM-4-100 manufactured by Toyo Baldwin K.K. at a pulling rate of 100%/min at a temperature of 25° C. and a relative humidity of 65%.

Melting Point and Heat of Fusion

They were measured by conducting thermometry in an atmosphere of a nitrogen gas using a Perkin-Elmer Model DSCI-B. The measurement was made using about 3 to 4 mg of a sample. The calibration of the temperature and the heat of fusion was made using indium having a high purity of 99.99%.

TABLE 1

| No. | Weight-average M.W. of poly-L-lactic acid | Weight-average M.W. of poly-D-lactic acid | Concn. of spinning dope (g/dl) |
|---|---|---|---|
| Ex. 1 | $9.2 \times 10^4$ | $9.0 \times 10^4$ | 15 |
| 2 | $26.5 \times 10^4$ | $28.3 \times 10^4$ | 10 |
| 3 | $40.0 \times 10^4$ | $36.0 \times 10^4$ | 5 |
| 4 | $40.0 \times 10^4$ | $9.0 \times 10^4$ | 8 |

TABLE 2

| No. | Draw ratio | Tensile strength (kg/mm$^2$) | Elastic modulus (kg/mm$^2$) | M.P. (°C.) | Heat of fusion (cal/g) |
|---|---|---|---|---|---|
| Ex. 1 | 6 | 39.5 | 427 | 231 | 37 |
| 2 | 13 | 73.7 | 653 | 235 | 41 |
| 3 | 22 | 168.6 | 1920 | 242 | 52 |
| 4 | 17 | 101.2 | 986 | 236 | 43 |

TABLE 3

| No. | Draw ratio | Tensile strength (kg/mm$^2$) | Elastic modulus (kg/mm$^2$) | M.P. (°C.) | Heat of fusion (cal/g) |
|---|---|---|---|---|---|
| Ex. 1 | 9 | 63.3 | 767 | 233 | 38 |
| 2 | 17 | 105.2 | 1093 | 237 | 45 |

TABLE 3-continued

| No. | Draw ratio | Tensile strength (kg/mm²) | Elastic modulus (kg/mm²) | M.P. (°C.) | Heat of fusion (cal/g) |
|---|---|---|---|---|---|
| 3 | 25 | 220.5 | 2889 | 245 | 54 |
| 4 | 21 | 186.4 | 2105 | 243 | 51 |

COMPARATIVE EXAMPLES 1 AND 2

Spinning dopes were prepared from a 5% chloroform solution of poly-L-lactic acid (weight-average molecular weight: $40.0\times10^4$) and a 5% chloroform solution of poly-D-lactic acid (weight-average molecular weight: $36\times10^4$). Dry spinning was conducted under the same conditions as those of Examples without blending. Drawing of the obtained fibers was attempted in a silicone oil bath having a temperature of 170° C. The fibers were molten and could not be drawn. Accordingly, drawing was conducted at 160° C. The results of tests of the physical properties of the obtained fibers are shown in Table 4.

TABLE 4

| No. | Sample | Draw ratio | Tensile strength (kg/mm²) | Elastic modulus (kg/mm²) | M.P. (°C.) | Heat of fusion (cal/g) |
|---|---|---|---|---|---|---|
| Comp. Ex. 1 | poly-L-lactic acid | 8 | 68.4 | 725 | 184 | 36 |
| 2 | poly-D-lactic acid | 8 | 65.9 | 703 | 182 | 35 |

We claim:

1. A polyactic acid fiber consisting of a blend of from 99 to 1 percent by weight of poly-L-lactic acid and from 1 to 99 percent by weight of poly-D-lactic acid, said fiber being drawn at a temperature of from 100° to 220° C. and a draw ratio of 13 or greater to make the tensile strength of said fiber at least 70 kg/mm².

2. A polylactic acid fiber as claimed in claim 1, which comprises 30 to 70 percent by weight of said poly-L-lactic acid and 70 to 30 percent by weight of said poly-D-lactic acid.

3. A polylactic acid fiber as claimed in claim 1, in which both said poly-L-lactic acid and poly-D-lactic acid have an average molecular weight of 20,000 to 1,000,000 and an optical purity of 90 percent or higher.

4. A fibrous article for the medical use, which is composed of the polylatic acid fiber as defined in claim 1.

5. A process for preparing a polylactic acid fiber, which comprises the step of spinning a blend consisting of from 99 to 1 percent by weight of poly-L-lactic acid and from 1 to 99 percent by weight of poly-D-lactic acid to form a fiber and then drawing said fiber at a temperature of from 100° to 220° C. and a draw ratio of 13 or greater to make the tensile strength of said fiber 70 kg/mm² or larger.

6. A process as claimed in claim 5, which is conducted from a solution of the blend in a solvent.

7. A process as claimed in claim 5, in which the drawing step is conducted with the wet hot drawing method or the dry hot drawing method.

8. A polylactic acid fiber as obtained by the process as defined in claim 5.

9. A polylactic acid fiber as claimed in claim 3 in which said poly-L-lactic acid and said poly-D-lactic acid have substantially the same weight-average molecular weights and they are blended at a weight ratio of 1:1 and said polylactic acid fiber has a melting point of at least 235° C.

10. A polylactic acid fiber as claimed in claim 3 in which said fiber has a tensile strength of at least 100 kg/mm² or higher.

11. A process as claimed in claim 5 in which the draw ratio is at least 17.

* * * * *